United States Patent [19]

Patriquin

[11] 4,398,405

[45] Aug. 16, 1983

[54] LOCK WITH KEY-CONTROLLED REMOVABLE AND INSTALLABLE PLUG AND KEY FOR SAME

[75] Inventor: George P. Patriquin, Gardner, Mass.

[73] Assignee: Product Concepts, Inc., Middlebury, Conn.

[21] Appl. No.: 249,165

[22] Filed: Mar. 30, 1981

[51] Int. Cl.[3] ..... E05B 29/04

[52] U.S. Cl. ..... 70/369; 70/375

[58] Field of Search ..... 70/369, 367, 368, 375, 70/377

[56] References Cited

U.S. PATENT DOCUMENTS

| | | | |
|---|---|---|---|
| 1,805,891 | 5/1931 | Shinn . | |
| 1,882,626 | 10/1932 | Jacobi . | |
| 1,905,639 | 4/1933 | Jacobi . | |
| 1,964,787 | 7/1934 | Voight | 70/369 |
| 1,968,555 | 7/1934 | Horne . | |
| 2,036,763 | 4/1936 | Lowe . | |
| 2,061,456 | 11/1936 | Falk . | |
| 2,065,683 | 12/1936 | Galagar | 70/369 |
| 2,460,709 | 2/1949 | Navarro . | |
| 3,722,243 | 3/1973 | Schiesteri . | |
| 4,191,037 | 3/1980 | Patriquin . | |

*Primary Examiner*—Robert L. Wolfe

*Attorney, Agent, or Firm*—Joseph S. Iandiorio

[57] ABSTRACT

A lock having a key-controlled removable and installable plug including: a plug including a set of combinating tumblers and a control tumbler including a retaining end and a second end; in a first state the retaining end being extended and the second end being retracted relative to the plug and in a second state the retaining end being retracted and the second end being extended relative to the plug; means for biasing the control tumbler to one of the states, the control tumbler including means for engaging with a key to drive the control tumbler to the other state; and a shell for rotatably receiving the plug and having a peripheral groove for receiving the retaining end of the control tumbler in the first state and preventing longitudinal withdrawal of, while permitting rotation of, the plug in the shell; and a longitudinal groove for accommodating extension of the second end in the second state and enabling withdrawal and installation of the plug when the second end is aligned with the longitudinal groove.

22 Claims, 19 Drawing Figures

LOCK WITH KEY-CONTROLLED REMOVABLE AND INSTALLABLE PLUG AND KEY FOR SAME

FIELD OF INVENTION

This invention relates to a lock having a key-controlled removable and installable plug and a key for same; and more particularly to such a lock in which the plug must be rotated to a specific position before the removal or installation can be effected.

BACKGROUND OF INVENTION

Conventional locks employ a key-operated plug rotatably mounted in a cylindrical shell. Absent the key, the combinating tumblers, which may be disks or pins, are biased to block rotation of the plug With disk tumblers, absent the key, the combinating disks extend into a longitudinal groove in the shell and prevent rotation of the plug. When the combinating tumblers read a properly bitted key inserted in the keyway they are set to the shear position and the plug is free to rotate: the lock is unlocked. Another groove may be provided to permit withdrawal of the key in the unlocked position. Each groove may be paired with a companion, diametrically opposed groove to allow disk tumblers to shift about as a key is inserted and withdrawn.

It is often necessary to replace the plug upon change of employee or tenant to prevent subsequent use of their key to gain access after they have left. Also equipment such as desks, filing cabinets, doors and the like are often supplied without plugs so that the locks in a particular set of desks, doors or other equipment can be actuated by common key.

In both cases, the replacement and installation, it is often necessary to use skilled labor. In some cases the plug is secured by means of a cam or other actuator on the back of the shell; in other cases a slidable member in the plug engages the shell and prevents withdrawal unless the member is depressed by a tool inserted through a hole in the shell. In both arrangements withdrawal is not possible unless the rear of the lock is accessible, which can be troublesome if the keys to a locked desk or filing cabinet are lost.

SUMMARY OF INVENTION

It is therefore an object of this invention to provide an improved lock in which the plug can be removed/installed by a key which engages a control tumbler.

It is a further object of this invention to provide such a lock in which the plug must be rotated to a predetermined position before the control key is effective to remove the plug.

It is a further object of this invention to provide such a lock in which the plug is enabled to rotate to the removal position when the combinating tumblers are properly read. It is a further object of this invention to provide such a lock in which the combinating tumblers and control tumbler may be actuated by the same key or different keys.

It is a further object of this invention to provide such a lock in which the control tumbler resists removal with a change key.

The invention features a lock having a key-controlled removable and installable plug including a plug and a shell. The plug has a set of combinating tumblers and a control tumbler. The control tumbler includes a retaining end and a second end. In the first state the retaining end is extended and the second end is retracted relative to the plug. In the second state the retaining end is retracted and the second end is extended relative to the plug. There are means for biasing the control tumbler to one of the states; the control tumbler includes means for engaging with a key to drive the control tumbler to the other state. The shell rotatably receives the plug and has a peripheral groove for receiving the retaining end of the control tumbler in the first state and preventing longitudinal withdrawal of, while permitting rotation of, the plug in the shell. The longitudinal groove accommodates extension of the second end in the second state and enables withdrawal and installation of the plug when the second end is aligned with the longitudinal groove.

In a preferred embodiment, the means for biasing biases the control tumbler to the first state and the key urges it to the second state. A containment surface may be provided in the shell for blocking movement of the second end from the first state to the extended second state, except when it is aligned with the longitudinal groove. The control tumbler may be a disk and the means for biasing may be a spring. The lock may further include actuator means rotatably mounted to the shell and means on the plug for engaging with the actuator means in one of a number of positions for rotation therewith. The peripheral groove may have various extents, for example approximately 90°, approximatey 180°, or a full 360°. With the full 360° peripheral groove, some stop means are provided for defining the limits of rotation of the plug. Insert means may be used in the peripheral groove for defining the limits of rotation of the plug and also to provide a containment surface for blocking movement of the second end from the first state to the second state.

The control tumbler may have a reference surface at least a portion of which is higher than the highest reference surface corresponding to the bitted portion of a key.

DISCLOSURE OF PREFERRED EMBODIMENT

Other objects, features and advantages will occur from the following description of a preferred embodiment and the accompanying drawings, in which.

Figure 1:
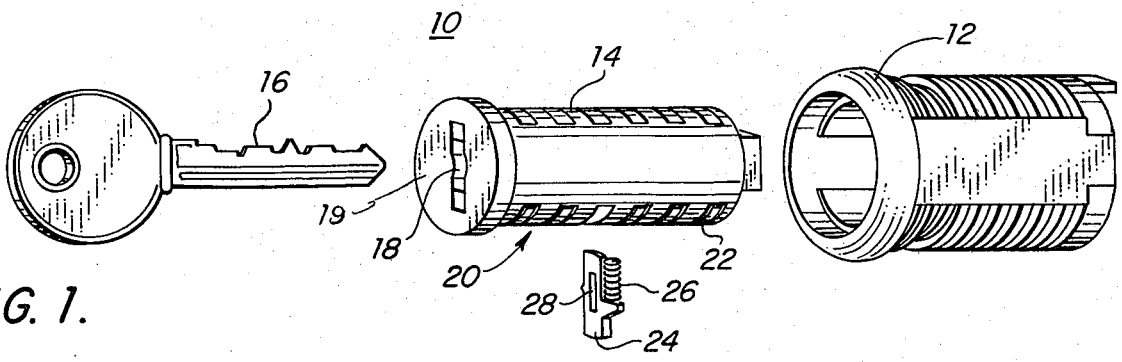
FIG. 1 is an exploded axonometric view of a lock according to this invention.

The invention may be accomplished with a lock having a key-controlled removable and installable plug. The lock includes a plug and a shell. The plug has a set of combinating tumblers and a control tumbler. The tumbler has a retaining end and a second end. In the first state the retaining end is extended and the second end is retracted relative to the plug, while in the second state the retaining end is retracted and the second end is extended relative to the plug. There are means for biasing the control tumbler to one of the states and the control tumbler includes means for engaging with a key to drive the control tumbler to one of the states: the control tumbler includes means for engaging with a key to drive the control tumbler to the other state. Typically, the means for biasing biases the control tumbler to the first state and the key drives the control tumbler to the second state. Although throughout this specification the invention has been illustrated using one control tumbler, more than one may be used in keeping with the invention, but at least one is necessary.

There is a shell, housing, or some other structure for rotatably receiving the plug, and there is a peripheral groove which receives the retaining end of the control tumbler in the first state and prevents longitudinal withdrawal of, while permitting rotation of, the plug in the shell. A longitudinal groove accommodates extension of the second end in the second state and enables withdrawal and installation of the plug when the second end is aligned with the longitudinal groove. There is a longitudinal groove for accommodating extension of the second end in the second state and enabling withdrawal and installation of the plug when the second end is aligned with the longitudinal groove. The longitudinal groove extends from the front of the lock toward the back of the lock sufficiently far enough to reach the plane of the peripheral groove. The peripheral groove may have any desired extent, for example 90°, 180°, or a full 360°. If the peripheral groove is less than 360° the remainder of that extent may include a containment surface for blocking movement of the second end from the first state to the extended second state, and there may also be provided stops as a part of or separate from the containment surface. Stops may also be provided by other means, both internal and external, i.e. stop washers, head stops and the like, in order to define the limits of rotation of the plug.

With the peripheral groove extending a full 360°, such an additional stop means would be provided. Alternatively, a peripheral groove having a full 360° extent may be converted to one of less than 360° by simply providing for inserts which would introduced into the groove to function as a containment surface and one or more stops.

Key means for operating the lock may include a first bitted portion for reading the combinating tumblers and enabling the plug to be rotated to align the second end of the control tumbler with the longitudinal groove, and a second bitted portion for driving the control tumbler to the second state to enable the removal of the plug. The key means may include two keys, one having the first bitted portion and the other the second bitted portion, or may include one having both bitted portions. There are four classes of keys referred to herein: change key, master key, control key, and master control key. The change key is an ordinary key commonly used to open or unlock a lock. For example, in a typical office having a number of desks, each desk would require its own specific change key to operate its lock. A master key is a key which could open all of those locks.

In accordance with this invention a change key or master key is typically used to operate the lock from the closed position to the open position. Once the lock is in the open position then a control key may be inserted. The control key is typically longer than a change key or master key to accommodate an extra bit which is the control bit that operates the control tumbler. When the lock is in the open position the control key is inserted and its control bit actuates the control tumbler to allow the plug to be withdrawn from the shell. A master control key is a key which combines both the master key function and control key function in one key: that is, with the lock in the locked position the master key is inserted to open the lock, that is, rotate the plug to the unlocked position. Up to that point the control tumbler prevents further insertion of the master control key, but at this point when the lock is unlocked, the control tumbler may be moved, that is driven to the second state. As the key is inserted completely, it drives the control tumbler to the second state and permits the plug to be withdrawn from the shell.

There is shown in FIG. 1 a lock 10 according to this invention which includes a shell 12 that houses a plug 14 and receives key 16 in keyway 18 in front face 19. Plug 14 includes a number of, e.g. five, combinating tumblers 20 and a control tumbler 22. Control tumbler 22 includes a disk tumbler 24 (shown removed from plug 14) which includes some means for biasing, spring 26, tumbler 24 to a first state and some means for engaging with a control key such as slot 28 for driving disk 24 to a second state. Combinating tumblers 20 may also be formed of disks 24.

Figure 2:
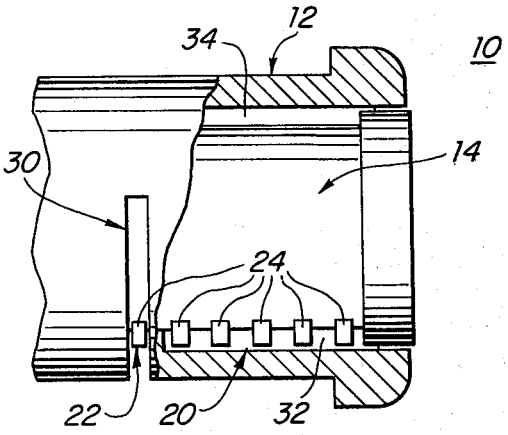
FIG. 2 is a side elevation view of a lock according to this invention with portions of the shell broken away and portions of the shell in section.
Figure 3:
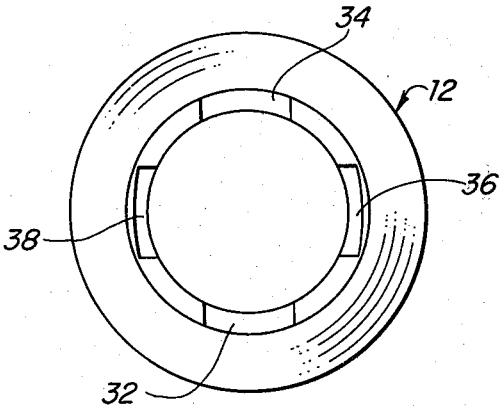
FIG. 3 is a front view of the lock of FIG. 2 with the plug removed.
Figure 4:
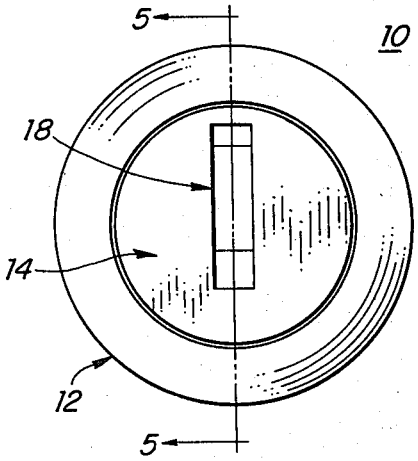
FIG. 4 is a front view of the lock of FIG. 2 with the plug in place.
Figure 5:
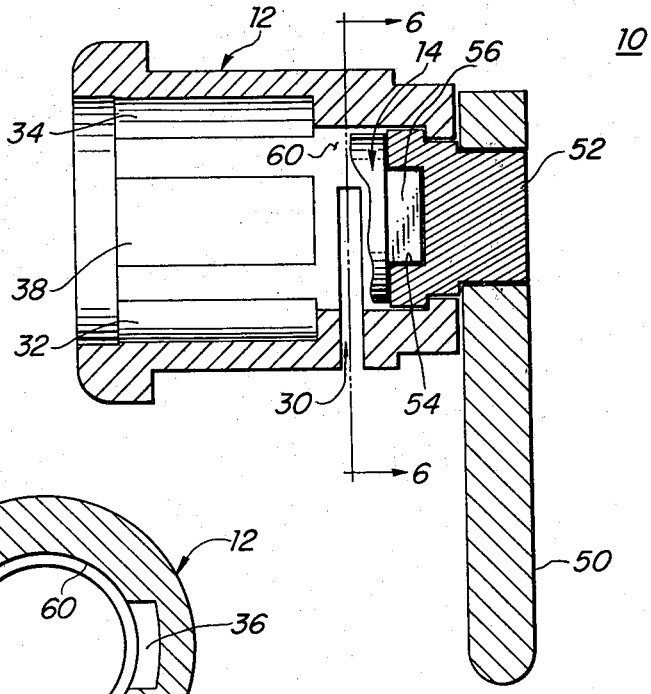
FIG. 5 is a sectional view taken along line 5—5 of FIG. 4 with the plug mostly removed.
Figure 6:
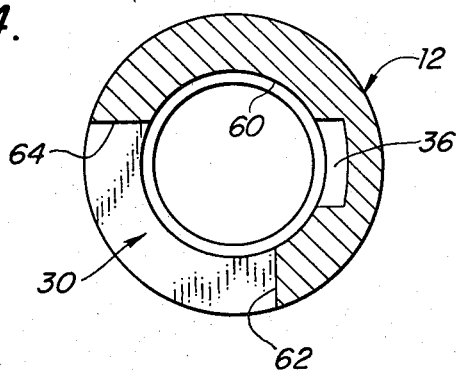
FIG. 6 is a sectional view taken along line 6—6 of FIG. 5 with all but the shell removed.

Shell 12 includes a peripheral groove 30 which may be cut right through the wall of shell 12 or may be a recess to accommodate the rotation of disk 24 of control tumbler 22 and yet prevent longitudinal movement thereof to prevent withdrawal of plug 14. Disks 24 of combinating tumbler 20 reside in the locked position in a longitudinal groove or spline 32. A companion spline 34 may be provided at a diametrically opposed position in order to allow tumblers 20 to freely move up and down as the key is inserted. When a key is inserted which properly reads combinating, tumblers 20, all five of the tumblers are withdrawn within the profile of plug 14, and the plug is enabled to rotate from that position to an unlocked position; for example the key can rotate from the position in FIG. 2 where the key and keyway, not shown, are in a locked vertical position, to an unlocked ninety degrees rotated from that position. If it is desirable to be able to remove the key in the unlocked position then a second set of splines 36, 38, FIG. 3, is provided. At least one spline should be provided at each position where a key is wished to be inserted or withdrawn. Plug 14 is shown in the locked position, FIG. 4, with its keyway 18 vertical. A cam 50, FIG. 5 may be attached to a rotatable member 52 which is spun over or otherwise fastened to cam 50 and is trunioned for rotation in the end of shell 12. Rotatable member 52 includes a splined hole 54 having for example a square cross section which receives in it a square lug 56 on the end of plug 14 so that cam 50 may be rotated with plug 14. With a four-sided splined hole 54 and four-sided lug 56, cam 50 may be set at any one of four positions relative to keyway 18 by setting cam 50 to the desired relative position prior to insertion of plug 14. Longitudinal grooves or splines 32, 34, 38 extend to but do not intersect with slot 30 nor with the containment surface 60 that extends around the reamining approximately 270° of shell 12 not utilized by the approximately 90° extent of slot 30. Slot 30 has a lower stop 62 for the locked position and upper stop 64 for the unlocked position. In FIG. 6 slot 30 extends for slightly more than ninety degrees in order to accommodate for the width of the control tumbler and permit it to operate over a ninety degree rotational range or sector. Only spline 36 reaches deep enough into shell 12 to enter containment surface 60 as far as slot 30.

Figure 7:
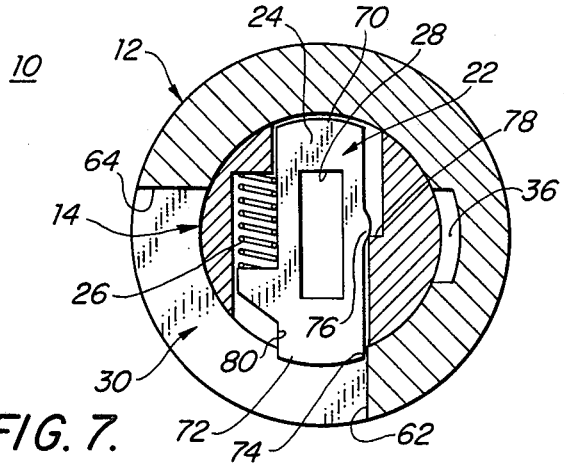
FIG. 7 is a sectional view taken along line 6—6 of FIG. 5 with the plug in a locked position in the shell and the control tumbler in the first state with its retaining end extended.

In the locked position, FIG. 7, slot 28 of disk 24 of control tumbler 22, aligned with keyway 18, is vertical. The upper second end 70 of disk 24 is retracted relative to plug 14 and the lower retaining end 72 is extended into slot 30 with its edge 74 abutting stop 62. Spring 26 biases disk 24 into this first state and detent 76, resting on ledge 78, limits the extension of disk 24 in this state.

Figure 8:
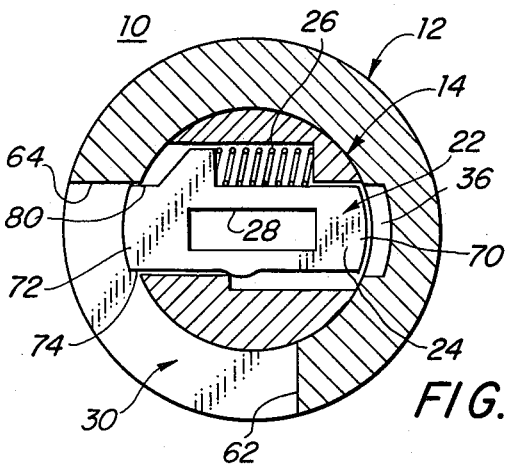
FIG. 8 is a view similar to FIG. 7 with the plug and control tumbler rotated 90° to the unlocked position.

Upon insertion of a change key or a master control key which properly reads the combinating tumblers, plug 14 may be rotated to the unlocked position shown in FIG. 8. In this position disk 24, still in the first state, has its edge 80 up against stop 64, and its second end 70 is aligned with spline 36.

Figure 9:
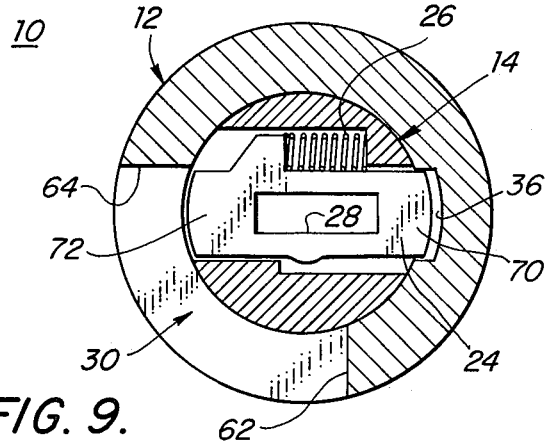
FIG. 9 is a view similar to FIG. 8 with the control tumbler driven by a control key to the second state for removal.

If now the control key is inserted or the master control key with the proper control bit is further inserted so that slot 28 is engaged, disk 24 is driven to the right as shown in FIG. 9, so that its second end 70 enters spline 36 and its retaining end 72 moves clear of slot 30 and stop 64.

Plug 14 may now be withdrawn from shell 12.

Figure 10:
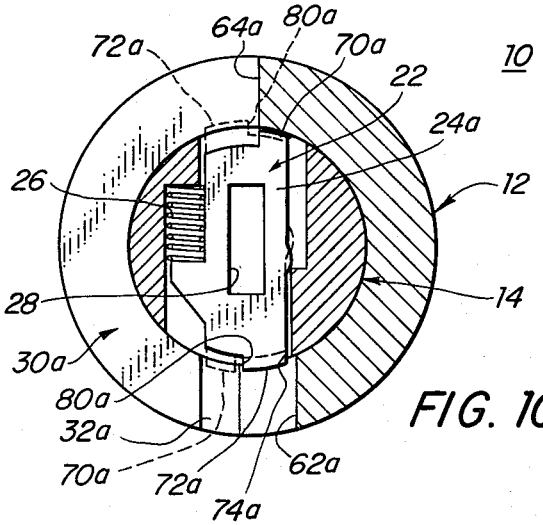
FIG. 10 is a view of a lock similar to FIG. 7 but with provision for a one hundred eighty degree rotation of the plug, showing the locked position and, in phantom, the one hundred eighty degree rotated unlocked position.

Although thus far the illustrated embodiment discloses a slot 30 as extending approximately ninety degrees, this is not a necessary limitation of the invention. For example, slot **30*a*, FIG. 10, has a length of approximatey one hundred eighty degrees from stop 62*a* to stop 64*a*. To accommodate this, control tumbler 22 disk 24*a* is modified: retaining end 72*a* and its locking end 70*a* are somewhat narrower than the full width of disk 24*a*. When properly read by the key, combinating tumblers permit rotation of plug 14 in housing 12 from a locked position shown in full line in FIG. 10, to the one hundred eighty degree unlocked position shown in phantom. In the locked full-line position edge 74*a* abuts stop 62*a* and in the one hundred eighty degree rotated unlocked position, edge 80*a* abuts stop 64*a*. In the rotated position second end 70*a* is aligned with spline 32*a*, which has been elongated to extend through the containment surface opposite slot 30*a* to function as slot 36 previously. Spline 32*a* is narrowed at its end, where it accommodates the control tumbler, disk 24*a*. The width of retaining end 72*a* is greater than the width of the end of spline 32*a* to prevent end 72*a* from being received in spline 32*a***. Up to that point where it accommodates the combinating tumblers, it is as wide as usual to accommodate the normal width of the ends of the other tumblers.

Figure 11:
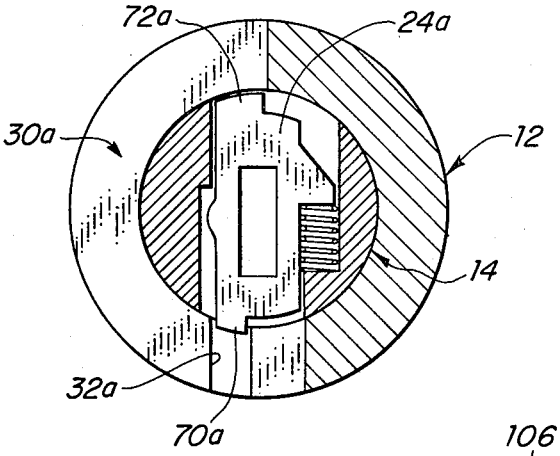
FIG. 11 is a view similar to FIG. 10 with the control tumbler driven by the control key to the second state to allow withdrawal of the plug.

If now a control key or master control key with the proper control bit is inserted, disk **24*a* is driven downwardly, FIG. 11, so that second end 70*a* is received in spline 32*a* and retaining end 72*a* is clear of slot 30*a*, and plug 14 may be removed from shell 12**.

Figure 12:
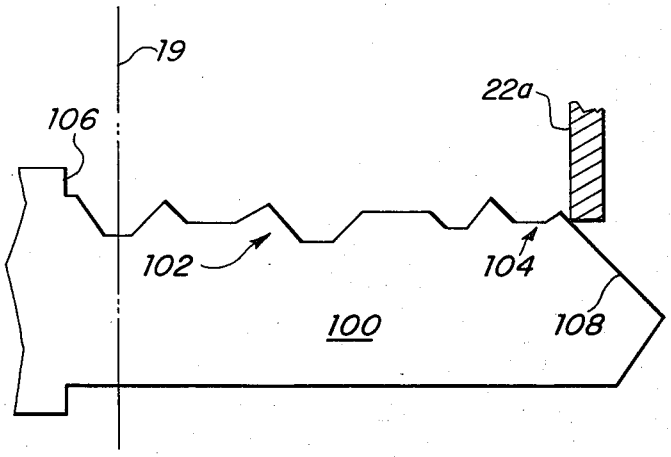
FIG. 12 is a schematic side elevational view of a combined master-control key and a portion of a control tumbler.

Instead of using two keys, one a change key or master key to operate the lock and a second, control key to operate the retaining tumbler to remove the plug, both functions may be contained in a single key, a master control key, with the control tumbler acting to restrict that key to operating as a change key or master key until the lock is operated and the plug is in the open state, whereupon that key may be further inserted to operate as a control key to remove the plug. For example, master control key 100, FIG. 12, has a bitted portion 102 for operating the combinating tumblers and a control bit 104 for operating the control tumbler **22*a***.

Upon insertion of key 100 into the lock of this invention, motion of key 100 is arrested before key stop 106 comes into contact with face 19. Its motion is arrested at this point by control tumbler **22*a*, which engages with edge 108 of key 100 and obstructs further penetration of key 100. However, at this position bitted portion 102** reads the combinating tumblers and allows the plug to be rotated to the unlocked position.

In the unlocked position control tumbler **22*a* may be driven upwardly out of the way be edge 108 as key 100 is inserted farther to the position where key stop 106 confronts face 19. Then control tumbler 22*a*** is positioned to permit removal of the plug, as previously explained.

Figure 13:
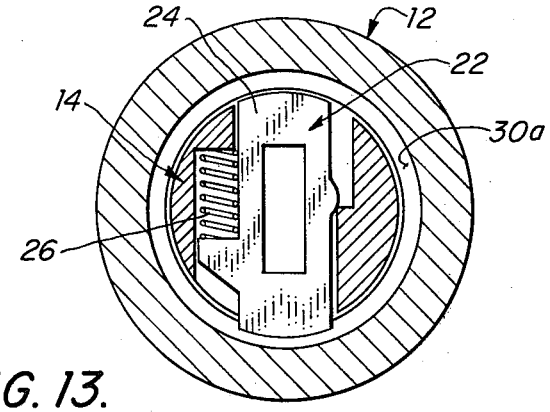
FIG. 13 is a view similar to FIG. 7 but with a full 360° internal peripheral groove.
Figure 14:
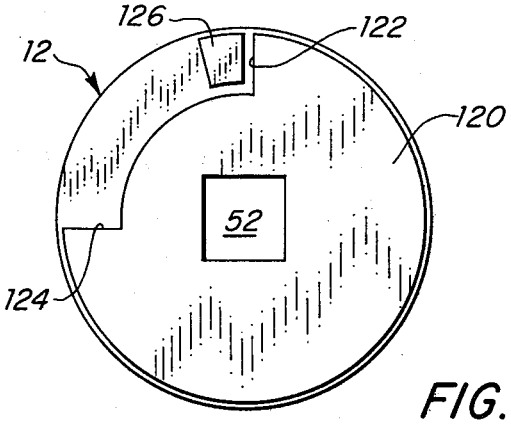
FIG. 14 is a schematic diagram of a back end of a lock showing a conventional stop washer and stop for defining the limits of rotation of the plug.

Although thus far peripheral groove **30*a* is shown fabricated by means of a slot through the wall of shell 12, this is not a necessary limitation of the invention, for as shown in FIG. 13 peripheral groove 30*a* may be formed for a full 360° wholly internally on the inner surface of shell 12. This construction eliminates stops 62 and 64. Stops may be provided by external or internal structures, e.g. by use of stop washer 120, FIG. 14, whose bearing surfaces 122 and 124 are arrested when they come into contact with stop 126 which is fixed to shell 20**.

Figure 15:
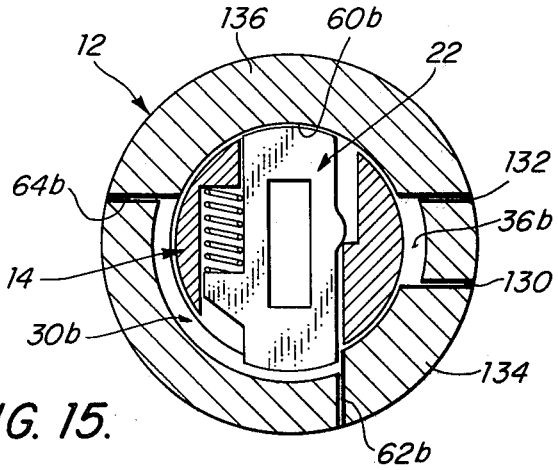
FIG. 15 is a view similar to FIG. 13 illustrating the use of inserts in a full 360° peripheral groove to provide a containment surface and stops.

Alternatively, containment surface **60*b* and stops 62*b* and 64*b***, *FIG. 15, may be provided in the continuous 360°* groove **30*b* by cutting slots 130 and 132 in shell 12 which receive inserts 134 and 136, respectively. Insert 134 provides stop 64*b* on one edge, and insert 136 provides stop 64*b* on one of its edges. Insert 136 holds or provides containment surface 60*b* and between the two other edges of inserts 134 and 136, longitudinal grooves 36*b*** are once again provided.

A lock normally has a number of combinating discs, and in accordance with this invention a control disc.

Figure 16:
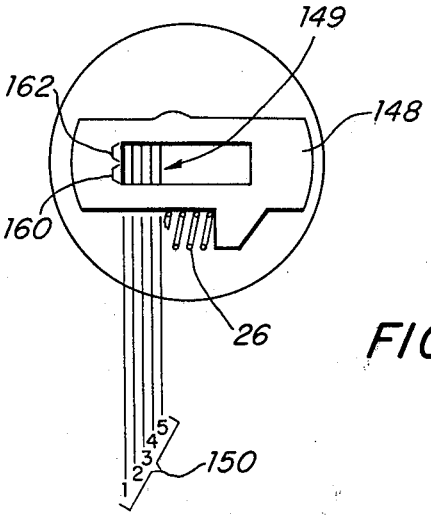
FIG. 16 is a diagrammatic view of discs with various reference levels at shear in the plug of a lock.
Figure 17:
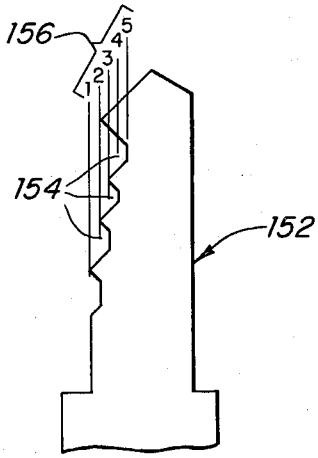
FIG. 17 is a side elevational diagram of a portion of a key bitted to operate the discs of the plug in FIG. 16.

Each disc 148, FIG. 16, includes a reference surface 149 which may be at any one of a number e.g. five different levels 150. The matching key 152, FIG. 17, has bitted portions 154 whose depths corresponds to the same levels 156. When key 152 is inserted so that each bitted portion engages a disc with a reference surface of corresponding level, the discs are in shear, FIG. 16, and the lock is unlocked and may be rotated to access the control disc. Normally, the left half 160 of the reference surface receives the change key; the right half 162 receives the master key.

A change key which is unbitted or cut to the highest level, number 1, might be made to operate the control disc and permit removal of the plug. For example, the change key could be filed back at the shoulder, then first inserted to the normal depth to reach the combinating discs and open the lock. Then after opening the lock the key is inserted fully. If the reference surface of the control disk is other than a level 1 the disc will be lifted to shear and allow withdrawal of the plug, alternatively, after opening the lock with a conventional change key, an unbitted key may be used to read the control disc.

Figure 18:
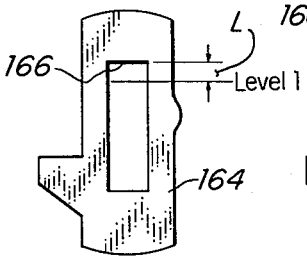
FIG. 18 is a diagrammatic view of an improved control disc with a raised reference surface according to this invention.
Figure 19:
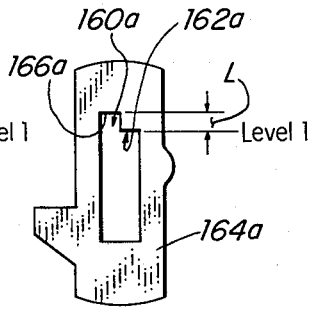
FIG. 19 is a diagrammatic view of an improved control disc with a raised reference for use in a mastered system.

To prevent such action, control disc 164, FIG. 18, may have a reference surface 166 some distance "L" above the normal 1 level so that a 1 bit or blank key cannot read it to shear. For systems having a master key, only the change key side of the disc may be altered, FIG. 19.

Other embodiments will occur to those skilled in the art and are within the following claims:

What is claimed is:

1. A lock having a key-controlled removable and installable plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell, and a longitudinal groove for accommodating extension of said second end in said second state and enabling withdrawal and installation of said plug when said second end is aligned with said longitudinal groove.

2. The lock of claim 1 in which said means for biasing biases said control tumbler to said first state and said key urges it to said second state.

3. The lock of claim 1 in which said control tumbler is a disk and said means for biasing is a spring.

4. The lock of claim 1 further including a containment surface in said shell for blocking movement of said second end from said first state to the extended second state.

5. The lock of claim 1 further including actuator means rotatably mounted to said shell, and means on said plug for engaging with said actuator means in one of a number of positions for rotation therewith.

6. The lock of claim 1 in which said peripheral groove extends for approximately ninety degrees.

7. The lock of claim 1 in which said peripheral groove extends for approximately one hundred eighty degrees.

8. The lock or claim 1 in which said peripheral groove extends for approximately three hundred sixty degrees.

9. The lock of claim 8 in which said lock further includes stop means for defining the limits of rotation of said plug.

10. The lock of claim 8 in which said shell further includes insert means in said peripheral groove for defining the limits of rotation of said plug.

11. The lock of claim 8 in which said shell further includes insert means in said peripheral groove for providing a containment surface for blocking movement of said second end from said first state to said second state.

12. The lock of claim 1 in which said shell includes a second longitudinal groove spaced from said longitudinal groove, said set of combinating tumblers lock at said second longitudinal groove and unlock, when properly read to enable the plug to rotate and align said retaining end of said control tumbler, at said longitudinal groove.

13. The lock of claim 1 in which said control tumbler has a reference surface at least a portion of which is higher than the highest reference surface corresponding to a bitted portion of a key.

14. The lock of claim 1 further including key means including a first bitted portion for reading said combinating tumblers and enabling said plug to be rotated to align the said second end of said control tumbler with said longitudinal groove and including a second bitted portion for driving said control tumbler to second state to enable removal of said plug.

15. The lock of claim 14 in which said key means includes two keys, one having said first bitted portion, the other said second bitted portion.

16. The lock of claim 14 in which said key means includes one key having both bitted portions.

17. A lock having a key-controlled removable and installable plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell; a containment surface for blocking movement of said second end from the first state to the extended second state; and a longitudinal groove traversing said containment surface for accommodating extension of said second end in said second state and enabling withdrawal and installation of said plug when said second end is aligned with said longitudinal groove.

18. A lock having a key-controlled removable and installation plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a three hundred and sixty degree peripheral groove for receiving said retaining end of said control tumbler in said first state and preventing longitudinal withdrawal of, while permitting rotation of, said plug in said shell, and a longitudinal groove for accommodating extension of said second end in said second state and enabling withdrawal and installation of said plug when said second end is aligned with said longitudinal groove.

19. A lock having a key-controlled removable and installable plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell; a containment surface for blocking movement of said second end from the first state to the extended second state; and a longitudinal groove traversing said containment surface for accommodating extension of said second end in said second state and enabling withdrawal and installation of said plug when said second end is aligned with said longitudinal groove; and key means including a first bitted portion for reading said combinating tumblers and enabling said plug to be rotated to align the said second end of said control tumbler with said longitudinal groove and including a second bitted portion for driving said control tumbler to said second state to enable removal of said plug.

20. A lock having a key-controlled removable and installable plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell; and a longitudinal groove for accommodating extension of said second end in said second state and enabling withdrawal and installation of said plug when said second end is aligned with said longitudinal groove; and key means including a first bitted portion for reading said combinating tumblers and enabling said plug to be rotated to align the said second end of said control tumbler with said longitudinal groove and including a second bitted portion for driving said control tumbler to said second state to enable removal of said plug.

21. A lock having a key-controlled removable and installation plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell; a containment surface for blocking movement of said second end from the first state to the extended second state; and a longitudinal groove traversing said containment surface for accommodating extension of said second end in said second state and enabling withdrawal and installation of said plug when said second end is aligned with said longitudinal groove; and key means including a first bitted portion for reading said combinating tumblers and enabling said plug to be rotated to align the said locking end of said control tumbler with said longitudinal groove and including a second bitted portion for driving said control tumbler to said second state to enable removal of said plug.

22. A lock having a key-controlled removable and installable plug comprising:

a plug including a set of combinating tumblers and a control tumbler including a retaining end and a second end, in a first state said retaining end being extended and said second end being retracted relative to said plug, in a second state said retaining end being retracted and said second end being extended relative to said plug; means for biasing said control tumbler to one of said states, said control tumbler including means for engaging with a key to drive said control tumbler to the other state; and a shell for rotatably receiving said plug and having a peripheral groove for receiving said retaining end of said control tumbler in said first state and preventing longitudinal withdrawal of, while permitting rotation of, said plug in said shell, and a longitudinal groove for accommodating extension of said second end in said second state and enabling withdrawal and installation of said plug when said second end is aligned with said longitudinal groove.

* * * * *